United States Patent [19]

DeSantis

[11] Patent Number: 5,063,314

[45] Date of Patent: Nov. 5, 1991

[54] MISWIRE-PROOF INTERCONNECTING TERMINAL BLOCK

[75] Inventor: John J. DeSantis, Dewitt, N.Y.

[73] Assignee: Carrier Corporation, Syracuse, N.Y.

[21] Appl. No.: 604,537

[22] Filed: Oct. 29, 1990

[51] Int. Cl.[5] ..... H01R 9/16

[52] U.S. Cl. ..... 310/71; 439/723

[58] Field of Search ..... 310/71, 68 R; 439/720, 439/721, 723, 724

[56] References Cited

U.S. PATENT DOCUMENTS 2,507,242 5/1950 Bost ..... 310/71

2,531,719 11/1950 Alvino ..... 310/71

2,923,913 2/1960 Kulka ..... 439/720

3,231,767 1/1966 Powell ..... 310/71

*Primary Examiner*—Steven L. Stephan

*Assistant Examiner*—D. Rebsch

[57] ABSTRACT

Miswiring of a multivoltage compressor motor is prevented by the use of a phase barrier having integral jumper bars for connecting pins in the correct pattern for the chosen voltage. The phase barrier for the chosen voltage is placed on the pins extending from a terminal plate and the appropriate connections to the power source are made.

3 Claims, 4 Drawing Sheets

MISWIRE-PROOF INTERCONNECTING TERMINAL BLOCK

BACKGROUND OF THE INVENTION

Devices such as compressors often have different models with the only structural difference being in the wiring so that the motor may be powered at different voltages. In the case of a compressor, electrical power is connected to the motor through the shell or housing of the compressor via a terminal block. The terminal block has a plurality of bores for sealingly receiving pins or bolts that provide internal and external connections to the motor and power source, respectively. In order to provide the different voltage operations, extra pins or bolts are present and the power source must be connected to the pins or bolts in a different manner for each operating voltage. The extra pins or bolts necessary to provide the flexibility of connections, as well as the different connections, can result in improper connections and damage to the motor.

SUMMARY OF THE INVENTION

The present invention provides phase barriers between the external connections on the terminal block which are not to be coupled via jumper bars for the particular voltage configuration. Additionally, indicia are provided on the external portion of the phase barrier indicating the voltage of the connection configuration.

It is an object of this invention to provide a miswire proof phase barrier for a multivoltage motor.

It is another object of this invention to prevent miswiring of a multivoltage motor compressor. These objects, and others as will become apparent hereinafter, are accomplished by the present invention.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
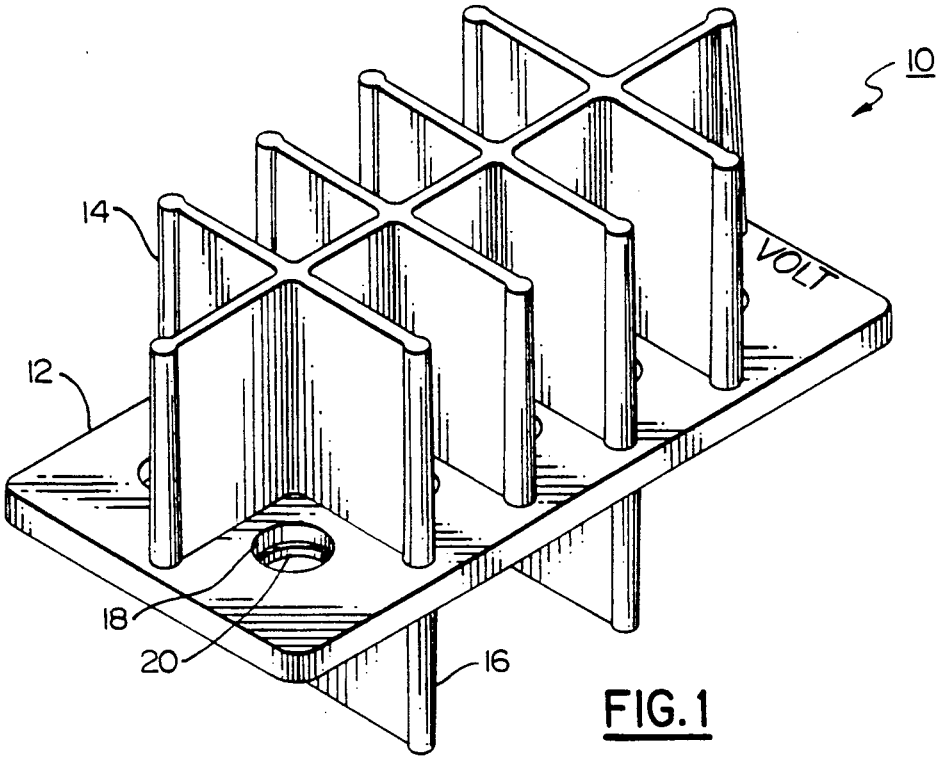
FIG. 1 is a perspective view of a first embodiment of the phase barrier of the present invention.
Figure 2:
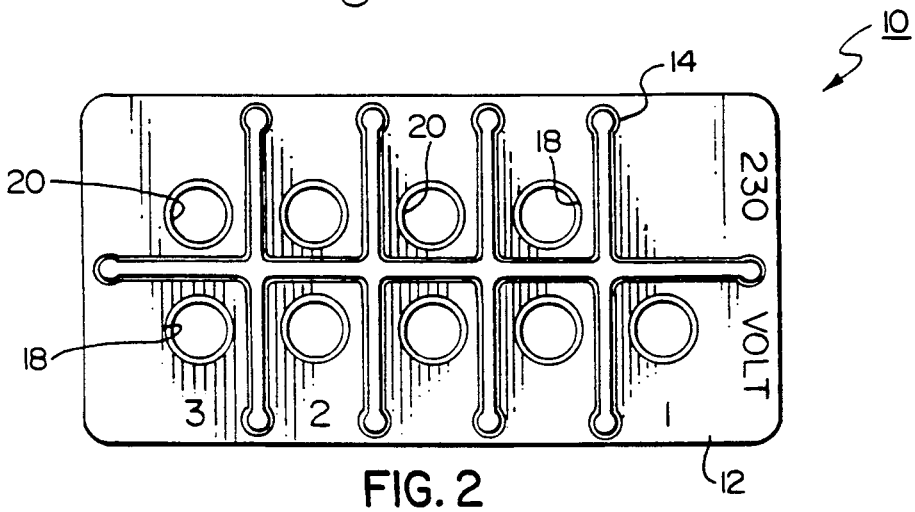
FIG. 2 is a top view of the FIG. 1 embodiment.
Figure 3:
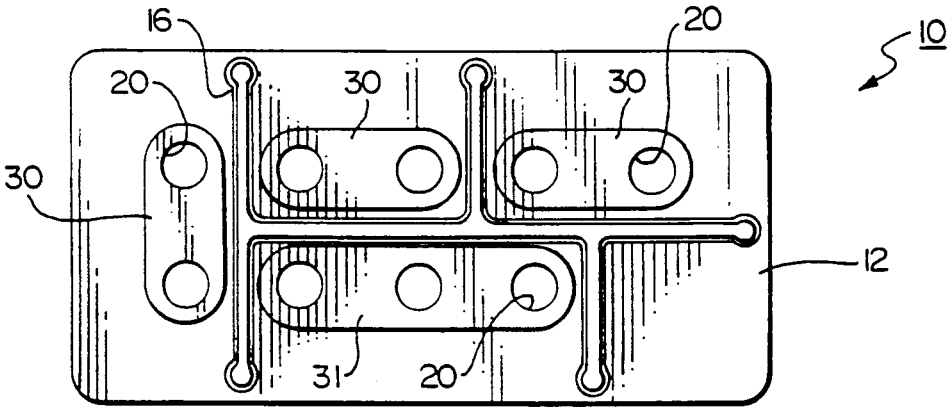
FIG. 3 is a bottom view of the FIG. 1 embodiment.
Figure 4:
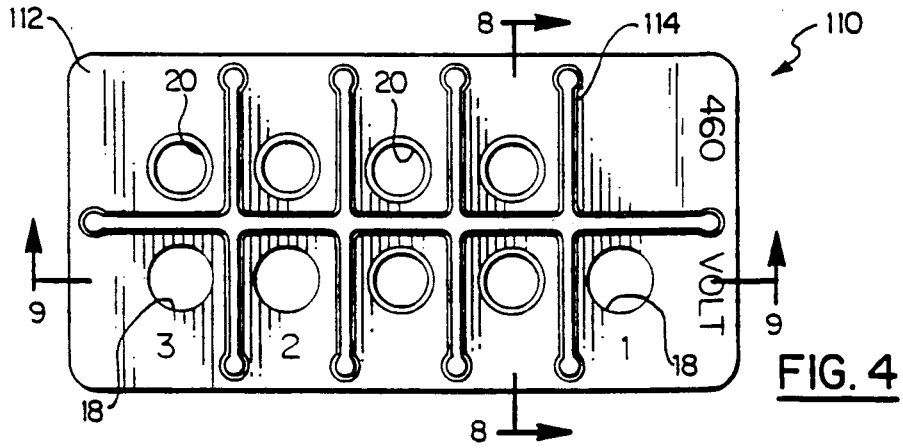
FIG. 4 is a top view of a second embodiment.
Figure 6:
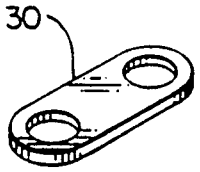
FIG. 6 is a perspective view of a two-post jumper bar.
Figure 7:
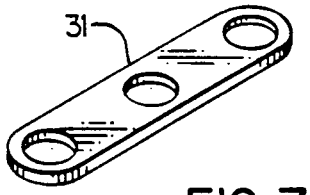
FIG. 7 is a perspective view of a three-post jumper bar.

In FIGS. 1–3 the numeral 10 generally designates a phase barrier configured for a 230 volt connection and having indicia on the plate portion 12 indicating the voltage connection and the locations for connecting the three leads. As best shown in FIG. 1, the phase barrier 10 includes an upper phase barrier portion 14 and a lower phase barrier portion 16 located on opposite sides of and integral with plate portion 12. Plate portion 12 and phase barriers 14 and 16 are made of a non-arc tracking material such as Valox 752 which is a thermoplastic polyester resin available from General Electric. Referring now to FIG. 2, it will be noted that a plurality of bores 18 are separated from each of the other bores 18 on the upper side of plate 12 by upper phase barrier portion 14. It will be further noted in FIG. 2 that each of the bores 18 is essentially coaxial with a smaller bore 20 which is located in jumper bars 30 and 31 of FIGS. 6 and 7, respectively. Bores 20 are preferably smaller than bores 18, to provide a better electrical connection, but may be of the same or larger size if desired. Referring now to FIG. 3, it will be noted that three two-post jumper bars 30 and one three-post jumper bar 31 are molded or otherwise permanently or semi-permanently attached to the bottom of plate portion 12 and form the smaller bored portion 20. Each of the jumper bars 30 and 31 is separated from the other jumper bars by lower phase barrier portion 16, but each jumper bar 30 and 31 provides a common electrical connection to each of the pins or bolts connected thereto.

Figure 5:
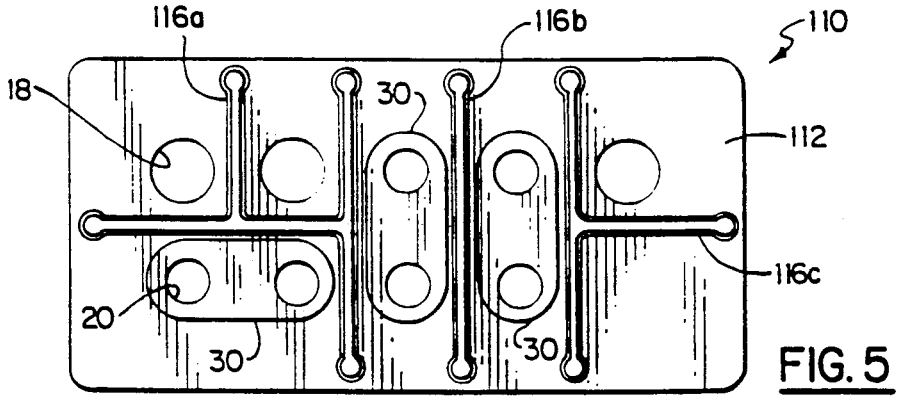
FIG. 5 is a bottom view of the FIG. 4 embodiment.

Referring now to FIGS. 4, 5, 8, and 9, modified corresponding parts have been labeled one hundred higher than in the FIG. 1–3 embodiment. Phase barrier 110 is configured for a 460 volt connection and FIG. 4 differs from FIG. 2 only in the voltage indicia and the presence of bores 20 in only some of the bores 18. It will be noted that the locations for connecting the three leads is the same as in the device of FIGS. 1–3. With reference to FIG. 5, it will be noted the three two-post jumper bars 30 are molded or otherwise permanently or semi-permanently attached to the bottom of plate portion 112. The lower phase barrier portion is made in three sections 116*a-c* so that each of the jumper bars 30 are separated from each other, as well as from the bores 18 which do not have jumper bars and are also separated from each other.

Figure 8:
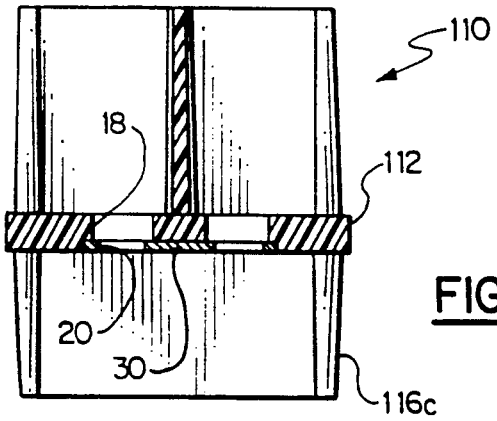
FIG. 8 is a sectional view taken along line 8—8 of FIG. 4.
Figure 9:
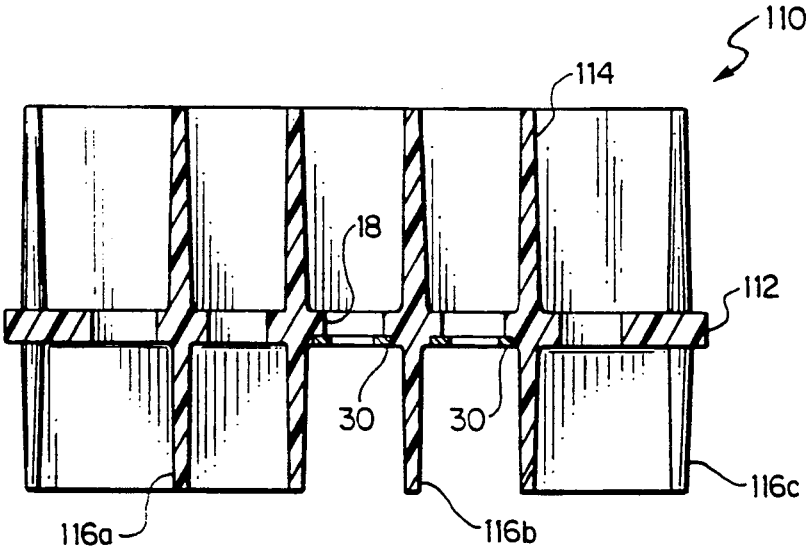
FIG. 9 is a sectional view taken along line 9—9 of FIG. 4.

FIGS. 8 and 9 show the relationship between the jumper bars, as exemplified by jumper bar 30, with the plate portion 112, upper phase barrier portion 114 and lower phase barrier portions 116*a-c* of phase barrier 110. The relationships of the corresponding parts of phase barrier 10 would be the same.

Figure 10:
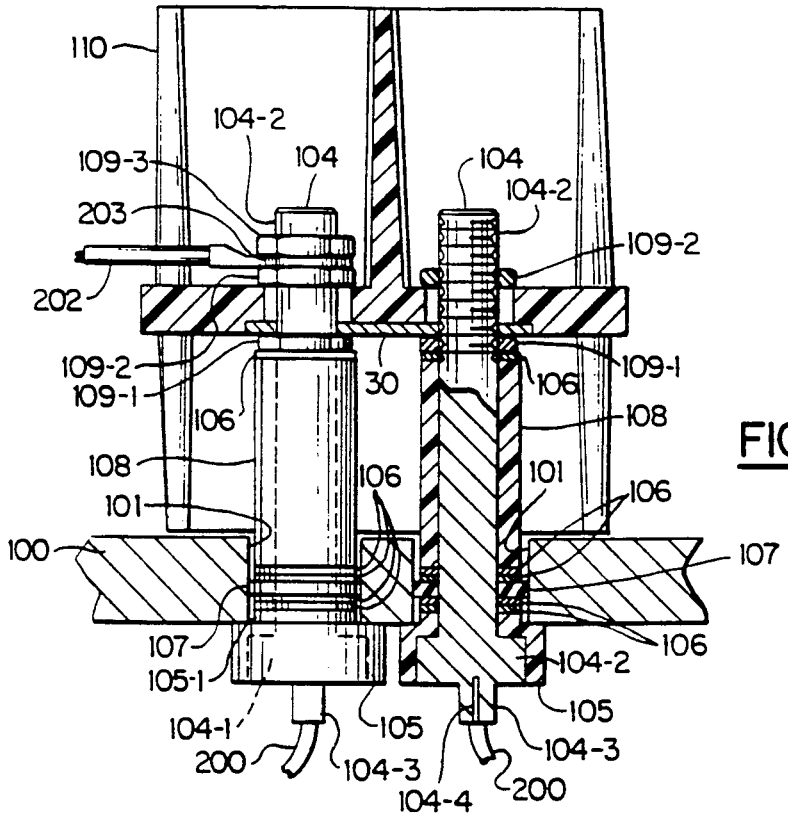
FIG. 10 is the same as FIG. 8 except that the phase barrier is in place on the terminal block.
Figure 11:
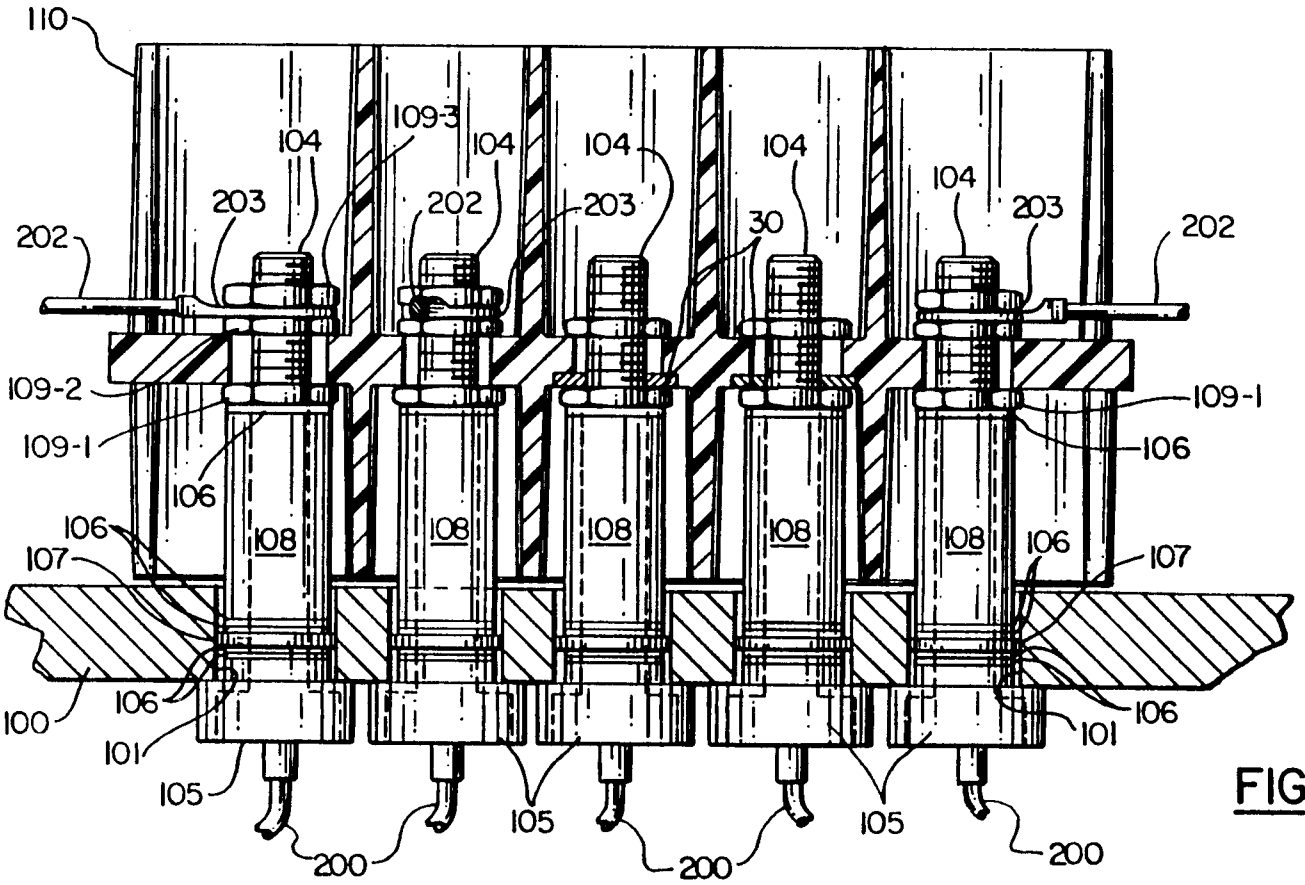
FIG. 11 is the same as FIG. 9 except that the phase barrier is in place on the terminal block.

A multivoltage compressor would have a plurality of pins or bolts extending through the terminal plate secured to the housing of the compressor. For the illustrated devices there would be nine pins or bolts extending out from the terminal plate in two rows of four and five, respectively. Depending upon whether 230 or 460 volt operation is desired phase barrier 10 or 110, respectively, would be placed over the bolts or pins and the jumper bars 30 and 31 will correctly configure the electrical connections when the leads are then connected to the bolts or pins. The three power leads would be connected at the locations numbered "1", "2" and "3", respectively, which are located the same for both embodiments. However, in the embodiment of FIGS. 1–3 the connection is to each of the two-post jumper bars 30, but in the FIG. 4 embodiment the connection is to the pins which are not connected to jumper bars 30 or 31. FIGS. 10 and 11 are the same as FIGS. 8 and 9, respectively, except for the additional structure of the terminal plate. Referring primarily to FIG. 10 because of its greater detail, the numeral 100 designates the terminal plate which is sealed to the shell or housing of the compressor (not illustrated). Nine bores 101 are formed in terminal plate 100 with their spacing and pattern corresponding to those of bores 18. Each bore 101 has a bolt 104 extending therethrough. Bolt 104 has a head 104-1 and a threaded portion 104-2. Head 104-1 has a extension 104-3 having a bore 104-4 for receiving motor lead 200 in place by crimping extension 104-3. Head 104-1 is received in inner insulating block 105 which has a reduced diameter portion 105-1 which is received in bore 101 and surrounds bolt 104. Serially located on bolt 104 starting with inner insulating block 105 are washers 106, rubber seal 107, washers 106, insulated spacer 108 and hex nut 109-1. When hex nut 109-1 is tightened on bolt 104 rubber seal 107 is extruded into sealing contact with bore 101 to thereby prevent leakage from the interior of the compressor via bores 101 in the terminal plate 100. With a bolt 104 located in each of the bores 101, as described, either phase barrier 10 or 110 could be placed thereon depending upon which operating voltage is chosen With phase barrier 110 in place, as illustrated, a hex nut 109-2 is threaded onto each of the bolts 104 and phase barrier 110 is held firmly in place and spaced a small distance from terminal plate 100. As illustrated in FIG. 10, jumper bar 30 electrically connects two of the bolts 104 and so it is only necessary to connect one of the two bolts 104 to the power source. However, in the embodiment of FIGS. 4, 5, 8–11 the power source is not connected to the jumper bar 30 but this connection is correct for FIGS. 1-3 embodiment and is shown only to illustrate the nature of the connection. Accordingly, annular terminal end 203 of power lead 202 is placed over an appropriate one of the bolts 104 designated by "1", "2" or "3", and hex nut 109-3 is threaded onto bolt 104 to keep terminal end 203 in place. Leads 202 would be connected to the other appropriate bolts 104. This arrangement is to be contrasted to the placing of jumper bars 30, 31 onto bolts 104 with a significant risk of error, then placing a phase barrier in place which hides the jumper bars from sight, and making the connection.

Although preferred embodiments of the present invention have been illustrated and described, other changes will occur to those skilled in the art. For example, more or fewer pins/bolts can be used and their pattern changed. Also, the jumper bar may be located on the upper/exposed portion of the phase barrier to reduce the chance of connecting leads to bolts already powered via a jumper bar and this can essentially be achieved by inverting the phase barrier and moving one bolt. Further, the phase barriers 14, 114 and 16, 116 may be in mirror image patterns so that the upper side reflects the presence/location of the jumper bar. It is therefore intended that the present invention is to be limited only by the scope of the appended claims.

What is claimed is:

1. A miswire proof phase barrier means comprising:

a plate of a non-arc tracking material having a first side and a second side and a plurality of spaced bores having essentially parallel axes and extending through said plate;

a plurality of jumper bars having at least two bores which are spaced in accordance with said spacing of said spaced bores in said plate;

each of said jumper bars being located on and attached to said first side of said plate in registration with associated ones of said bores in said plate;

first axial phase barrier means located on said first side and generally parallel to said axes of said bores in said plate and separating each of said jumper bars and said associated bores in said plate from all other bores on said first side of said plate; and second axial phase barrier means located on said second side and generally parallel to said axes of said bores in said plate and separating each of said bores in said plate from each of the other bores in said plate.

2. A miswire proof phase barrier means adapted to coact with the pins of an electrical device where said pins are located in a predetermined pattern so as to provide a selected electrical connection between said pins and an external power source comprising:

a plate of a non-arc tracking material having a first side and second side and a plurality of bores formed in said predetermined pattern having essentially parallel axes and extending through said plate so as to receive said pins when placed thereon;

a plurality of jumper bars with each jumper bar having at least two bores which are spaced in accordance with said predetermined pattern so as to be in registration with associated ones of said bores in said plate and to provide an electrical connection between each of said pins contacting each of said jumper bars;

first axial phase barrier means located on said first side and generally parallel to said axes of said bores in said plate and separating each of said jumper bars and said associated bores in said plate, and thereby the pins therein, from all other bores on said first side of said plate; and second axial phase barrier means located on said second side and generally parallel to said axes of said bores in said plate from each of the other bores in said plate.

3. The miswire proof phase barrier means of claim 2 further including indicia on said second side denotating the location for connecting said external power source.

* * * * *